US005361412A

United States Patent [19]

Perry

[11] Patent Number: 5,361,412

[45] Date of Patent: Nov. 8, 1994

[54] EMERGENCY PREPAREDNESS VEST APPARATUS

[76] Inventor: Betty J. Perry, 32 W. Rawhide, Gilbert, Ariz. 85234

[21] Appl. No.: 47,468

[22] Filed: Apr. 19, 1993

[51] Int. Cl.[5] ..... A41D 1/04; A41D 13/00

[52] U.S. Cl. ..... 2/69; 2/94; 2/102; 2/108; 2/247; 224/252; 224/253

[58] Field of Search ..... 2/102, 108, 94, 247, 2/248, 249, 250, 251, 252, 338, 310, 311, 312, 300, 69, 69.5, 75, 80, 105, 106; 224/222, 267, 252, 253

[56] References Cited

U.S. PATENT DOCUMENTS

| | | | |
|---|---|---|---|
| 262,577 | 8/1882 | Day | 2/94 |
| 1,656,684 | 1/1928 | Tamborello | 2/84 |
| 2,136,380 | 11/1938 | Garrison | 2/84 |
| 4,034,417 | 7/1977 | Ellis | 2/108 |
| 4,241,459 | 12/1980 | Quayle | 2/102 |
| 4,637,075 | 1/1987 | Ingrisano et al. | 2/102 X |
| 4,676,419 | 6/1987 | Victor | 224/253 |
| 5,072,455 | 12/1991 | St. Ours | 2/102 |
| 5,075,900 | 12/1991 | Chittenden | 2/102 |
| 5,127,565 | 7/1992 | Grant | 224/252 |
| 5,195,187 | 3/1995 | Yang | 2/102 |

*Primary Examiner*—Jeanette E. Chapman
*Attorney, Agent, or Firm*—H. Gordon Shields

[57] ABSTRACT

Emergency preparedness vest apparatus includes a front panel and a back panel, each of which panels include pockets for receiving and holding elements to sustain a wearer during an emergency situation. The elements include food, clothing, and shelter elements. Included in the arrangement of the pockets are both inside and outside pockets. The outside pockets are substantially more numerous than the inside pockets, and receive individual items, while the inside pockets may receive larger, more bulky items, such as clothing and a ground cloth. The vest may be sized appropriate to the wearer.

17 Claims, 2 Drawing Sheets

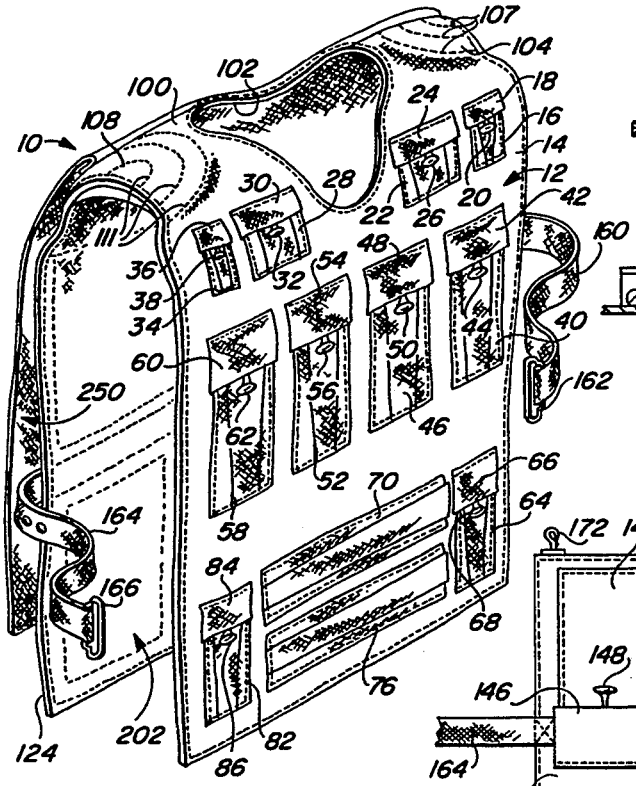
FIG. 1
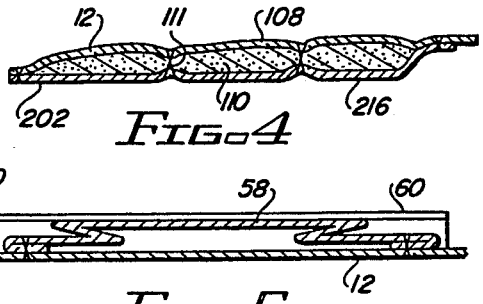
FIG. 4
FIG. 5
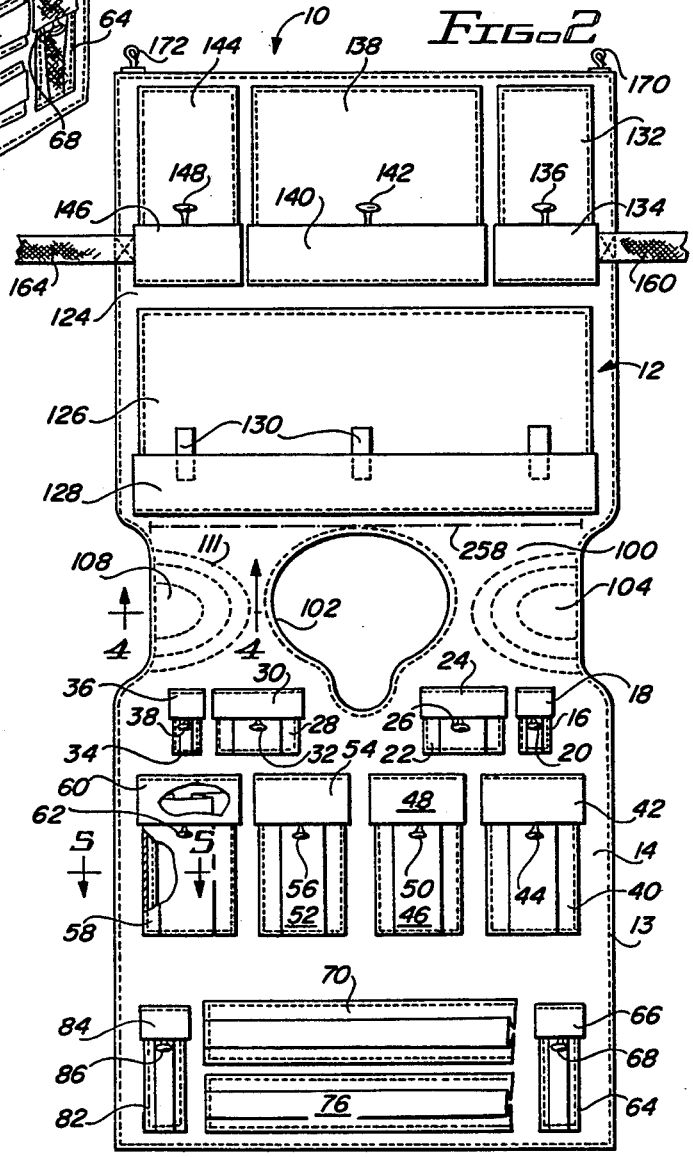
FIG. 2
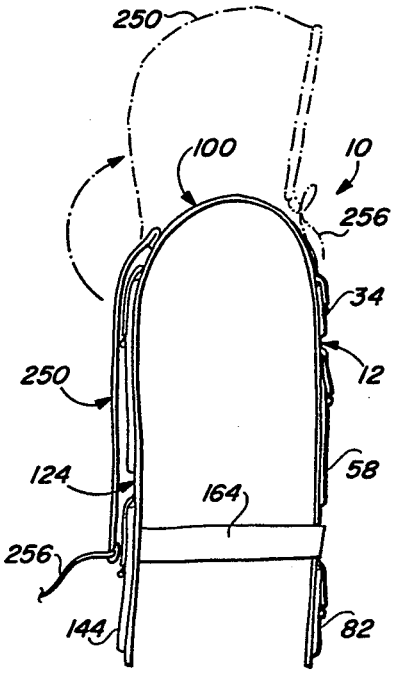
FIG. 8

EMERGENCY PREPAREDNESS VEST APPARATUS

BACKGROUND OF THE INVENTION

1. Field of the Invention

This invention relates to vests having a plurality of pockets for emergency preparedness or survival purposes.

2. Description of the Prior Art

Different types of survival or emergency preparedness vests have been developed in the past, each of which has been developed or designed for a specific purpose. For example, there have been survival vests designed for and worn by fliers. Such vests include pockets for food packets, first aid kits, and different elements useful in an emergency situation by a downed flier.

There have been other vests designed for hunters and fishermen. For hunters, the vests have typically included pockets for survival elements, including food, first aid, fire making, etc. For fishermen, vests have typically included pockets for accessories for fishing purposes as well as food items. The vests for fishermen have been more of a utilitarian nature, dealing with fishing, than for emergency preparedness or survival.

Recent events, such as earthquakes, fires, etc., have demonstrated the practicability and the advisability of being prepared for various types of emergencies. It has been suggested that a seventy-two hour time period, or three days, is sufficient for the re-establishment of normal facilities after a disaster of one kind or another. That is, people should ideally be able to maintain themselves for a period of three days in the event of an emergency situation. The idea of maintaining oneself includes providing food, clothing, water, and a shelter of some type.

The apparatus of the present invention comprises a vest which may be tailored to the size of an individual and to allow the individual to essentially provide in a single garment food, clothing, and shelter for a limited time. The provision for large quantities of water is, of course, not practical in a vest type garment. However, a vest type garment, such as the apparatus of the present invention, allows a person to conveniently carry a quantity of water in addition to food, clothing, and a type of shelter, for emergency sustenance. Except for water, the apparatus of the present invention may provide food, clothing, and other elements for a period of several days, such as the above referred to three day (72 hour) time period.

U.S. Pat. No. 3,885,248 (Salsby) discloses a hunting vest which includes a mesh foundation. The apparatus also includes a sack.

U.S. Pat. No. 4,041,549 (Atkinson) discloses a vest with removable pocket elements. The vest apparatus includes a pocket on the back of the apparatus and stiffening elements for the front of the vest apparatus.

U.S. Pat. No. 4,669,127 (Swanson) discloses a pack vest which includes a plurality of pockets or compartments on both the front and back of the vest. A water repellent seat protector extends downwardly from the back of the vest as protection while the wearer sits.

U.S. Pat. No. 5,014,359 (Hanson) discloses a combination vest and backpack apparatus. The apparatus consists essentially of three primary elements which may be appropriately secured together. The three elements, when laid out, comprise a generally "Y" configuration, with portions of the upper arms being securable to the sides of the stem of the "Y" portion. The stem of the "Y" comprises the back portion of the apparatus. When the arm portions are secured to the back or stem portion, the vest is ready to be worn, and the front of the arm portions then zip together to comprise the front of the vest.

The apparatus of the present invention includes both exterior and interior pockets for carrying different types of elements and goods, and the structure is accordingly substantially different from the structure of the above discussed patents.

SUMMARY OF THE INVENTION

The invention defined and claimed herein comprises a vest having a plurality of pockets for receiving different types of emergency elements, including first aid elements, food, cooking equipment, mechanical survival elements, such as, a knife, fishing equipment, documents, clothing, a drop cloth, and the like. The vest also includes a cover which may be used as a sun visor to protect the wearer from the sun or to protect the wearer from rain, and the like. The vest apparatus may be sized appropriately for a particular wearer, such as a child, a youth, or an adult.

Among the objects of the present invention are the following:

To provide new and useful vest apparatus;

To provide new and useful vest apparatus having a plurality of pockets;

To provide new and useful emergency preparedness vest apparatus;

To provide new and useful survival article wearable by a user and which article includes a plurality of pockets for receiving and carrying elements for providing food, clothing and shelter to the wearer; and To provide new and useful vest apparatus having a plurality of pockets for receiving emergency preparedness elements and having a cover to protect the head of the wearer.

BRIEF DESCRIPTION OF THE DRAWING

FIG. 1 is a perspective view of the apparatus of the present invention.

FIG. 2 is a plan view of one side of the apparatus of FIG. 1.

FIG. 4 is a view in partial section taken generally along line 4—4 of FIG. 2.

FIG. 5 is a view in partial section taken generally along line 5—5 of FIG. 2.

FIG. 8 is a side view of the apparatus of the present invention in its general use environment.

DESCRIPTION OF THE PREFERRED EMBODIMENT

Figure 3:
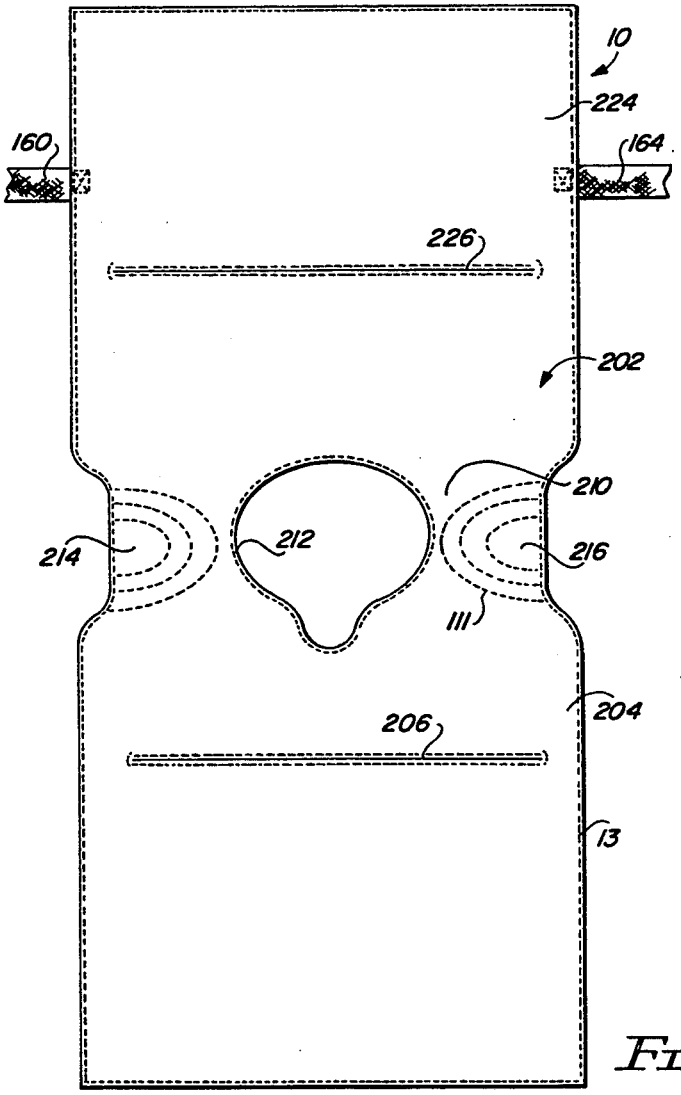
FIG. 3 is a plan view of the opposite side of the apparatus of FIG. 1 from that shown in FIG. 2.

FIG. 1 is a view of emergency preparedness vest apparatus 10 embodying the present invention. The vest apparatus 10 generally includes two base layers of material appropriately stitched together. The layers of material include an outer layer 12 and an inner layer 202. A plurality of pockets are appropriately secured to the outer layer 12. The two layers 12 and 202 generally have the same configuration and are appropriately stitched together at their outer peripheries by stitching 13 and at other areas which will be discussed in detail below. A plurality of pockets are secured to the outer layer 12, and the inner layer 202 includes merely slits. The purpose of the pockets and the slits will be discussed in detail below.

FIG. 2 is a plan view of the vest apparatus 10, illustrating the outer layer 12 and the plurality of pockets appropriately secured, as by stitching, to the outer layer 12.

FIG. 3 is a plan view of the vest 12, and particularly of the inner layer 202, showing the various elements associated therewith. For the following discussion, reference will primarily be made to FIGS. 1, 2, and 3. Reference will be made to the other Figures as appropriate.

Both the outer layer 12 and the inner layer 202 are preferably made of canvas duck material which is both relatively strong and relatively light weight. The inner layer 202 may be lighter material, if desired.

As may be seen from FIGS. 2 and 3, the vest apparatus is generally of a rectangular configuration, elongated, as appropriate, to extend down the front and the back of a user or wearer. The outer layer 12 is divided generally into two portions, a front portion 14 and a back portion or rear portion 124. A plurality of pockets is fastened or secured, as by stitching, to both the front portion 14 and the back portion 124.

Between the front portion 14 and the rear portion 124 is a top or shoulder area 100. A head opening 102 extends through the top or shoulder area 100. At the outer edges of the top or shoulder area 100 are two shoulder pad areas, a shoulder pad area 104 and a shoulder pad area 108. FIG. 4 is a view in partial section taken generally through the shoulder Dad area 108.

The inner layer 202 is similarly divided into two portions, a front portion 204 and a rear portion 224. The inner layer 202 also includes a top or shoulder area 210 disposed between the front portion 204 and the rear portion 224. The inner layer 202 also includes a head opening 212 which has substantially the same configuration, of course, as the head opening 102 of the outer layer 12. The two layers 12 and 202 are appropriately stitched together about the head openings 102, and 212.

FIG. 4 shows the shoulder areas 108 and 216 in detail. Padding is disposed between the outer layer 12 and the inner layer 202 at both shoulder areas. Padding 110 is shown in FIG. 4 at the shoulder arm 108, 216. The padding 110 is appropriately secured in place by stitching 111. The stitching 111, as may be noted from FIGS. 2 and 3, extends in a curved fashion or manner between the outer edge or perimeter of the shoulder area 100, 210, inwardly. The stitching 111 includes rows of generally parallel stitching.

Both shoulder areas 104, 214 and 108, 216 are substantially identical to each other.

Referring again to FIGS. 1 and 2, the pockets on the outer layer 12 and at the front portion 14 are generally arranged in three rows. The top row includes four pockets, including a pocket 16, a pocket 22, a pocket 28, and a pocket 34. The pockets 16 and 34 are outer pockets, and the pockets 22 and 28 are inner pockets. The terms "outer" and "inner" refer to the proximity of the pockets to the outer or the side edges of the vest apparatus 10.

Each of the four pockets is appropriately sewn to the outer layer 12 at the sides and bottom of the pockets. The pockets are appropriately pleated to provide maximum carrying or holding capacity for each pocket. Each pocket is also closed by a top flap which is appropriately stitched to the outer layer 12 above the top of the pocket. The pocket 16 includes a flap 18, the pocket 22 includes a flap 24, the pocket 28 includes a flap 30, and the pocket 34 includes a flap 36.

Each flap is secured to its pocket by appropriate fastening means. The fastening means may include such things as a fastener secured to the pocket and an elastic loop secured to the flap. Fastener elements 20 are used to secure the flap 18 to the pocket 16, fastener elements 26 are used to secure the flap 24 to the pocket 22, fastener elements 32 are used to secure the flap 30 to the pocket 28, and fastener elements 38 are used to secure the flap 36 to the pocket 34.

The outer pockets 16 and 34 are generally narrow, or are narrower than the pockets 22 and 28. However, all four of the pockets 16 . . . 34 are preferably the same height or length. The pockets accordingly differ only in their width. For convenience, the outer pockets 16 and 34 are preferably the same width, and the inner pockets 22 and 28 are preferably of the same width.

There is a second or middle row of pockets, which are preferably all of the same size. The pockets include a pocket 40, a pocket 46, a pocket 52, and a pocket 58. In construction, the pockets 40 . . . 58 are substantially identical, with the carrying or molding capacity of each being substantially identical. The pockets 40 . . . 58 are preferably pleated to again maximize their carrying capacity.

Each pocket is closed by a flap and each flap is appropriately secured to a pocket by appropriate fastening elements. The pocket 40 includes a flap 42 and fastening elements 44. The pocket 46 includes a flap 48 and fastening elements 50. The pocket 52 includes the flap 54 and fastening elements 56. The pocket 58 includes a flap 60 arid fastening elements 62.

The third or bottom row of pockets include a pair of outer pockets 64 and 82, and a pair of inner pockets 70 and 76. The outer pockets 64 and 82 extend generally vertically, and accordingly are generally parallel to the top or first row of pockets 16 . . . 34 and to the second or middle row of pockets 40 . . . 58. However, the pockets 70 and 76 extend generally horizontally and accordingly are parallel only to each other. The pockets 70 and 76 are substantially elongated for holding relatively long elements or material.

All four of the pockets 64 . . . 82 are appropriately pleated to maximize their carrying capacity. The pockets 64 and 82 are closed by a flap and the flaps are secured to the pockets by appropriate fastening elements, such as discussed above. The pocket 64 is closed by a flap 66 and a pair of fastening elements 68. The pocket 82 is closed by a flap 84 and the flap and pocket are secured together by fastening elements 86. The horizontally extending pockets 70 and 76 are open.

The rear portion 124 of the front layer 12 includes only two rows of pockets, with only a single, relatively large pocket comprising the top row, and three relatively large pockets comprising the second row.

A pocket 126 extends generally the full width of the top of the rear portion 124 of the vest apparatus 10. The pocket 126 is appropriately secured to the outer layer 12, as by stitching. The pocket 126 is also pleated, as are the other pockets discussed above and below. The pocket 126 is stitched at its sides and bottom to the outer layer 12. A flap 128 closes the pocket 126. The flap 128 is secured to the pocket 126 by appropriate fastening elements, which may be a plurality of pairs of hook and loop type fasteners 130, for convenience.

The second or bottom row of pockets on the rear portion 124 includes three pockets, a pocket 132, a pocket 138, and a pocket 144. The outer pockets 132 and 144 are preferably about the same size, and the middle or central pocket 138 is preferably considerably larger in width than the pockets 132 and 144. However, all three pockets 132, 138, and 144 are preferably the same height. Again, each pocket is pleated and is appropriately secured to the outer layer 12 by stitching at the sides and bottom of the pockets.

The pocket 132 is closed by a flap 134, and the flap 134 is secured to the pocket 132 by appropriate fastening elements 136. The pocket 138 is closed by a flap 140, and the flap 140 is secured to the pocket 138 by appropriate fastening elements 142. The pocket 144 is closed by a flap 146, and the flap 146 is secured to the pocket 144 by appropriate fastening elements 148.

It will be noted that for convenience, the relatively large pocket 126 is preferably closed by hook and loop type fasteners, while other types of fastener element pairs may be used for the other pockets and flaps on both the front and the back of the vest apparatus. It will be obvious that, if desired, the same type of fasteners may be used for each flap and pocket as are used for the pocket 126. That is, hook and loop fasteners may be used, or some other fastener elements, such as discussed above, may be used.

It will be immediately recognized that many different types of emergency material or elements may be carried in various pockets on both the front and back of the vest apparatus 10. The type of fastening element is relatively immaterial.

With pockets of various sizes, different types of emergency preparedness material, depending on their size, may be appropriately carried in the various pockets. For example, elements such as first aid material, a compass, matches, and the like may be appropriately carried in the pockets 20 . . . 34 of the top front row. Slightly larger elements, such as perhaps a mirror, writing materials, and the like may be carried in the middle row of pockets 40 . . . 58. Food elements, such as energy bars, jerky, and the like, may also be carried in the middle row of pockets. Larger containers of food, such as the cans which typically contain tennis balls, may be disposed in the pockets 70 and 76 for holding more food products. Other survival or emergency material, such as water purification tablets, knives, etc., may be disposed in the outer pockets 64 and 82 on the bottom third row of pockets.

In the relatively large pocket 126 on the back 124, clothing, a drop cloth for shelter, and the like may be disposed. In the bottom row of pockets 132, 138, and 144, ready to eat meals, or MRE's, may be disposed.

Obviously, it will be up to the individual user of the vest apparatus 10 as to what elements are placed into which pockets. Medication, and the like, may need to be available very rapidly, and will be kept probably in the upper pockets, while clothing, and the like may be kept in the pockets in the back of the apparatus 124.

As shown in FIG. 2, a pair of snap hangars 170 and 172 are secured to the bottom edge at the rear of the vest apparatus 10. A bedroll, or the like, may be appropriately secured to the snap fastener elements 170 and 172.

For securing the vest apparatus to a user, a pair of belt elements 160 and 164 are preferably used. The belt element 160 include a buckle 162 and the belt element or portion 164 includes a buckle element 166. The belt portions 160 and 164 are secured to the side edges of the back portion 124 and are appropriately aligned with a space between the middle. The belt elements 160 and 164 extend around the area between the middle and bottom rows of pockets on the front portion 14. The belt portions 160 and 164 are preferably made of heavy trill. Their buckle elements 162 and 166 may be any appropriate fastening elements, as desired.

Referring now primarily to FIG. 3, the inner layer 202 of the vest apparatus 10 is illustrated in plan view. As indicated above, the outer layer 12 and the inner layer 202 are stitched together only at their outer periphery by stitching 13. In addition thereto, the shoulder areas are stitched together, with the padding between the two layers, as shown in FIGS. 1, 2, and 3, and as also shown in FIG. 4. Finally, the head opening, which include the head opening 102 for the outer layer 12 and the head opening 12 for the inner layer 202, are also stitched together at their periphery. With the limited stitching, there exists substantially a large open area between the two layers 12 and 102. This large open area comprises, for practical purposes, two large inner pockets.

The inner layer 202 is divided into two portions, a front portion 204 and a back or rear portion 224. A transversely extending slit 206 extends through the front portion 204, and a transversely extending slit 226 extends through the back portion 224. The slits 206 and 226 provide access to the relatively large pockets defined between the inner layer 202 and the outer layer 12. The slits 206 and 226 may be appropriately reinforced at their edges and at their ends, as desired, to insure the integrity of the slits and of the cloth inner layer 202.

Relatively large elements may be inserted into the inner pockets through the slits 206 and 226, as desired. Such things as valuable papers may also be inserted into those large pockets through the slits for extra safe keeping. It will be understood that the inner pockets are more protected than the outer pockets and, at the same time, are less accessible while the vest apparatus 10 is being used. Accordingly, elements which need not be readily available and which are relatively large, and perhaps even bulky, may preferably be stored in the large pockets in the inner layer. On the other hand, it is obvious that the vest apparatus 10 may be easily removed from a user or wearer to provide access to the inner pockets, as desired.

A flap 250 is shown secured to the back portion 12 by a stitch line 258 in FIG. 2. The stitch line 258 is disposed adjacent to the top or shoulder area 100, and slightly above the flap 128 of the pocket 126. The flap 250 may be used as a hood in inclement weather, or as a sunshade, if desired.

Figure 6:
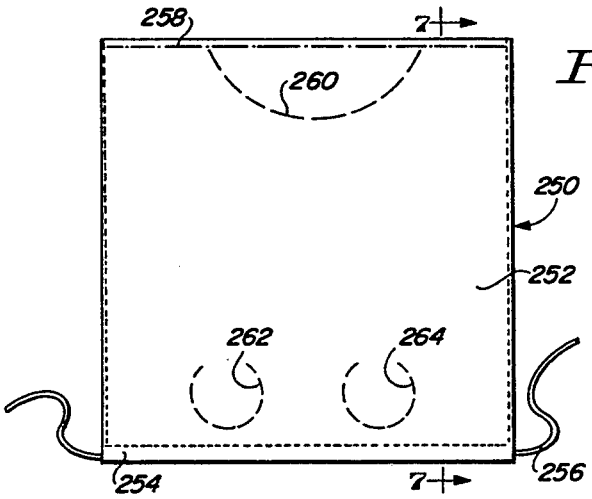
FIG. 6 is a plan view of a hood portion of the apparatus of the present invention.
Figure 7:
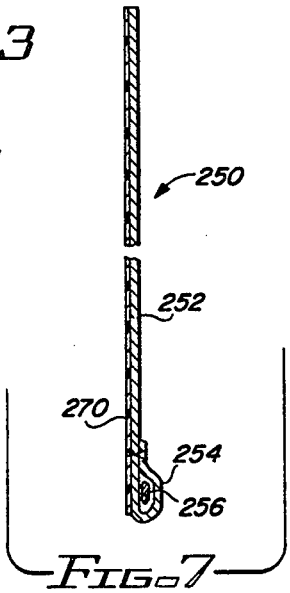
FIG. 7 is a view in partial section taken generally along line 7—7 of FIG. 6.

The flap 250 is shown best in FIGS. 1, 6, 7, and 8. FIG. 6 comprises a plan view of the flap 250, and FIG. 7 is a view in partial section through the flap 250 taken generally along lines 7—7 is FIG. 6. FIG. 8 comprises a side view of the vest apparatus 10 in its use orientation. The flap 250 is shown in its down or "normal" position, and is shown in a use position as a bonnet or hood, by a dash dot line. The pivoting of the flap 250 is indicated in FIG. 8 by a dash dot arrow.

The flap 250 includes two layers, an outer canvas layer 252 and an inner or back plastic layer 270. The layers 252 and 270 are preferably stitched together at their top, bottom, and outer peripheries.

The outer canvas layer 252 includes a bottom loop 254 and a drawstring 256 extends through the bottom loop 254. For using the flap 250 as a bonnet for rain protection or sun protection, the flap 250 is pivoted upwardly, as indicated by the dash dot arrow in FIG. 8, so as to cover the head of the user or wearer of the vest apparatus 10. The draw string 256 is pulled so as to gather the bottom or end of the flap 250 together and is appropriately tied, as in a bow, as shown in FIG. 8, also in dash dot line.

As shown in FIG. 6, the flap 250 may also be used as an infant carrier. For carrying an infant, the outer layer 252 includes three cuts indicated by dash dot lines. The cuts include a top generally semicircular cut 250 and a pair of leg flap cuts 262 and 264. The cuts 262 and 264 are generally circular, but do not comprise a complete circular cut, leaving a pair of flaps which cover the resulting pair of leg openings.

An infant may be disposed in the flap 250 by inserting the infant's body through the top cut 260, and letting the infant's legs extend outwardly through the cuts 262 and 264. It will be noted that the cuts 260, 262, and 264 do not comprise total openings, but rather are merely cuts in the outer layer 252, leaving flaps that help to maintain the integrity of the flap apparatus 250 when the flap 250 is used other than for an infant carrier.

Figure 9:
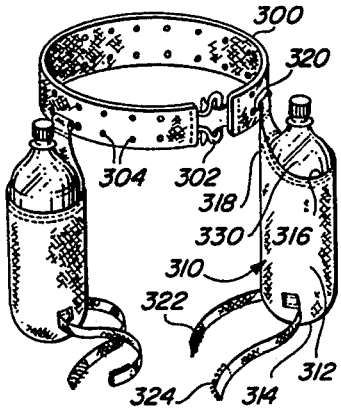
FIG. 9 is a perspective view of a portion of the apparatus of the present invention.
Figure 10:
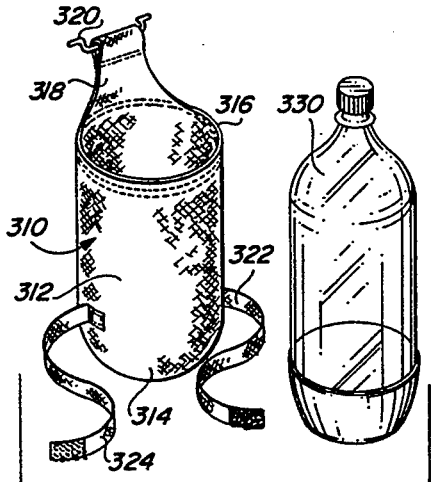
FIG. 10 is a perspective view of a portion of the apparatus shown in FIG. 9.

The transporting of water with the apparatus of the present invention is illustrated in FIGS. 9 and 10. FIG. 9 is a perspective view of a belt 300 with a pair of water bottle holsters 310 secured thereto. FIG. 10 is a perspective view of the water carrying holster 310. For the following discussion, reference will primarily be made to FIGS. 9 and 10.

In FIG. 9, a military type belt 300 is shown. The belt includes buckle elements 302 for fastening the ends of the belt together, and a plurality of riveted or reinforced holes 304. The holes 304 are spaced apart along the entire length of the belt 300.

A pair of carrier holsters 310 is shown secured to the belt 300. A holster 310 comprises a generally cylindrical bag element 312 with a closed bottom 314 and an open top 316. Extending upwardly from the cylinder or bag 312 is a flap 318. A fastener element 320 is appropriately secured to the top or upper portion of the flap 314. The carrier fastening element 320 is preferably a metallic bail with end loops or elements which extend through an aligned pair of the holes 304 of the belt 300.

A pair of leg straps 322 and 324 are appropriately secured to the cylinder or bag 312. The leg straps 322 and 324 may be tied around a thigh of a user to prevent the holster 310 from moving or flopping indiscriminately as the wearer moves.

The cylinder or bag 312 is appropriately dimensioned to receive a typical two liter plastic bottle, such as is common and well known and understood in the art. The open mop 316 is preferably elasticized to help hold a bottle 330 in the holster 310. The overall length or height of the cylinder 312 is accordingly slightly greater than the overall length of the maximum diameter of the bottle 330 so that the top 316 will rest on the inwardly extending shoulder of the bottle 330.

While a separate belt 300 is shown in FIG. 9, it is obvious that the belt or strap portions 160 and 164 may also include holes to which the holsters 310 may be secured, if desired. The advantage of using a separate belt 300, as opposed to the straps or belt elements 160 and 164, include the ability to carry a plurality of bottles, rather than perhaps only one holster and bottle at each side, or only a single holster secured to each belt portion 160 and 164. Thus, perhaps only two holsters 310, and accordingly only two bottles of water, may be carried when the holsters are secured directly to the belt or strap portions 160 and 164, but several more holsters, and accordingly several more bottles of water, may be secured to a separate belt which would go around the user's waist beneath the vest apparatus 10.

It is obvious that the vest apparatus 10 may be worn over a backpack, if desired, and that it may be made in various sizes to accommodate the different sizes of users. Moreover, it will be obvious that for use by children, the number and size of pockets on the outer layer 12 may vary. Moreover, for a child the bottle carrying holster 310 may be downsized to carry only a one liter bottle, instead of a two liter bottle. The vest apparatus is accordingly designed to be flexible and yet to provide a user with sufficient pockets, etc., for carrying the desired necessities of life for a short emergency period, such as a three day or 72 hour time period.

While the principles of the invention have been made clear in illustrative embodiments, there will be immediately obvious to those skilled in the art many modifications off structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What is claimed is:

1. Emergency vest apparatus, adapted to be worn by a user and disposed on the user's shoulders, comprising in combination:

outer layer means defining the outside of the vest apparatus, including a front portion and a back portion;

flap means secured to the outer layer means for providing a cover for the back portion of the outer layer means and a rain cover and sunshade for the user, including an outer layer and a generally waterproof layer secured together, and the outer layer includes openings for receiving an infant for converting the flap means into an infant carrier, with the infant disposed between the outer layer and the generally waterproof layer;

first pocket means, including a first plurality of pockets on the front portion and a second plurality of pockets on the back portion, for receiving and holding items desired by the user;

inner layer means defining the inside of the vest apparatus secured to the outer layer means, and including a front portion and a back portion; and second pocket means defined between the outer layer means and the inner layer means for receiving and holding items desired by the user.

2. The apparatus of claim 1 in which the outer layer means and the inner layer means both include a shoulder portion and a head opening extends through the outer and inner layer means at the shoulder portion.

3. The apparatus of claim 2 in which the shoulder portion including for the user's shoulders as the vest apparatus is worn.

4. The apparatus of claim 2 in which the flap means is secured to the back portion of the outer layer means adjacent to the shoulder portion.

5. The apparatus of claim 4 in which the outer layer is disposed on the users head when the flap means is used as a sunshade and as a rain cover, and the generally waterproof layer then becomes the outer layer for repelling rain.

6. The apparatus of claim 4 in which the flap means further includes drawstring means for tying the flap means to the user when the flap means is used as a sunshade and as a rain cover.

7. The apparatus of claim 1 in which the inner layer means includes means for providing access to the second pocket means defined between the inner and outer layer means.

8. The apparatus of claim 7 in which the second pocket means includes at least a single pocket between the front portions of the outer and inner layer means and at least a single pocket between the back portions of the outer and inner layer means.

9. The apparatus of claim 8 in which the means for providing access to the second pocket means includes at least a single slit in the front portion of the inner layer means for providing access to the pocket between the front portions of the inner and outer layer means and at least a single slit in the back portion of the inner layer means for providing access to the pocket between the back portions of the outer and inner layer means.

10. The apparatus of claim 1 in which the first pocket means includes flap means for covering at least some of the first plurality and the second plurality of pockets.

11. The apparatus of claim 10 in which the first pocket means further includes fastening means for securing the flap means to the first plurality and the second plurality of pockets.

12. The apparatus of claim 1 in which the first pocket means includes a plurality of generally parallel vertically extending pockets.

13. The apparatus of claim 12 in which the first pocket means further includes flaps for closing the plurality of generally vertically extending pockets.

14. The apparatus of claim 12 in which the first pocket means further includes at least a single horizontally extending pocket.

15. The apparatus of claim 1 in which the outer layer means further includes belt means for securing the front and back portions to the user.

16. The apparatus of claim 15 in which the belt means further includes means for carrying a container of water.

17. The apparatus of claim 15 in which the means for carrying a container of water includes a holster for receiving a container of water.

* * * * *